US005797579A

United States Patent [19]

Krinner

[11] Patent Number: 5,797,579

[45] Date of Patent: Aug. 25, 1998

[54] TREE STAND

[75] Inventor: Klaus Krinner, Strasskirchen, Germany

[73] Assignee: Krinner GmbH, Germany

[21] Appl. No.: 555,647

[22] Filed: Nov. 13, 1995

[30] Foreign Application Priority Data

Nov. 11, 1994 [DE] Germany ..... 9418163 U
Apr. 20, 1995 [DE] Germany ..... 295 06 736 U

[51] Int. Cl.[6] ..... F16M 13/00

[52] U.S. Cl. ..... 248/523; 47/40.5; 248/519; 248/524

[58] Field of Search ..... 248/511, 519, 248/523, 524, 527; 47/40.5, 42

[56] References Cited

U.S. PATENT DOCUMENTS

| | | | |
|---|---|---|---|
| 1,110,142 | 9/1914 | Piner | 248/524 X |
| 1,546,314 | 7/1925 | Prince | 248/524 |
| 2,023,340 | 12/1935 | Peskulich . | |
| 2,459,533 | 1/1949 | Irvin | 248/524 X |
| 3,231,226 | 1/1966 | Rossler | 248/524 X |
| 3,301,512 | 1/1967 | Nyberg . | |
| 4,130,965 | 12/1978 | Patton et al. | 248/524 X |
| 5,000,414 | 3/1991 | Rosato | 248/524 |
| 5,114,113 | 5/1992 | Krinner . | |
| 5,467,959 | 11/1995 | Behreinger | 248/523 |
| 5,490,350 | 2/1996 | Eisenschenk et al. . | |

FOREIGN PATENT DOCUMENTS

| | | | |
|---|---|---|---|
| 7 204 742 | 9/1972 | Germany . | |
| 39 32 473 A1 | 4/1991 | Germany . | |
| 92 16 396 | 5/1994 | Germany . | |
| 295 02 365 U | 6/1995 | Germany . | |
| 119581 | 7/1947 | Sweden | 248/524 |
| 163929 | 7/1958 | Sweden | 248/524 |

*Primary Examiner*—Derek J. Berger
*Attorney, Agent, or Firm*—Sterne, Kessler, Goldstein & Fox P.L.L.C.

[57] ABSTRACT

A tree stand featuring a plurality of retaining elements and a single clamping element which acts upon all of the retaining elements via a load transmission element. The load transmission element comprises a flexible, substantially inextensible connecting part having tensile strength which initially moves all of the retaining elements essentially free of a retaining force into contact with the trunk of the tree, and then presses all of the retaining elements against the tree trunk with an essentially identical retaining force.

15 Claims, 2 Drawing Sheets

TREE STAND

BACKGROUND OF THE INVENTION

1. Field of the Invention

The invention concerns a Christmas tree stand in accordance with the preamble of claim 1.

2. Description of the Prior Art

Christmas tree stands are known wherein a sheath positioned vertically upright on a plate or a base is provided, which has the function of receiving the lower end of the trunk of the Christmas tree. At regular distances in the peripheral wall of the sheath, peripheral clamping screws are provided which pass through the sheath and have the function of clamping and thus immobilising the trunk of the Christmas tree inside the sheath. Herein it is a disadvantage that only a small clamping effect can be made to bear on the stem via the clamping screws usually tightened by finger strength, such that the fastening of a Christmas tree by means of these known Christmas tree stands is not satisfactory. Furthermore, a precisely vertical positioning of the Christmas tree trunk, which is desirable for esthetic reasons, can be accomplished only with difficulty. Lastly, positioning and clamping requires the assistance of a second person as it practically is not possible to simultaneously hold the tree and tighten the clamping screws.

It is also known to immobilise the trunk of the Christmas tree in a correspondingly oversized bore of a base by means of wooden wedges.

German Utility Model No. 72 04 742 shows a bowl-shaped Christmas tree stand wherein four single clamping jaws may be pressed against the trunk surface of the Christmas tree by means of respectively associated positioning means which are operated one by one. The subject matter of this utility model is therefore merely a somewhat improved embodiment of a Christmas tree stand wherein, in accordance with the above explanation, a plurality of screws is pressed against the trunk circumference in the known manner until the trunk is fixed in a vertical position.

In the subject matter of U.S. Pat. No. 2,023,340, single retaining claws are biased against the trunk surface by a spring force such that, at correct positioning, automatic locking results owing to the weight of the tree. This Christmas tree stand can only be installed while either in a horizontal position or in a condition in which the tension spring is disconnected and the retaining claws are folded back, with a retaining spike centrally positioned on the Christmas tree stand in any case initially having to be twisted into the trunk. The vertical position of the tree is obtained only if each retaining claw is set to the correct height. Thus, alignment in a precisely vertical position is practically not achievable by a single person.

U.S. Pat. No. 3,301,512 shows a retaining device for Christmas trees wherein a clamping device operated by pedal is provided in a stand element. The clamping device proper is made up of hook-shaped, pivotally mounted claws, with a corresponding actuation of the pedal setting the retaining claws in motion via a deflection mechanism. In this case, the movements of the single retaining claws are forcedly coupled among each other, requiring a vertical alignment of the tree trunk itself as early as during application of the retaining force. In the case of trunks having uneven contours and/or obliquely cut trunk ends, safe vertical retention of the Christmas tree trunk is not ensured.

In the case of the Christmas tree stand according to German Utility Model No. 92 16 396, single elements for retaining the Christmas tree trunk are provided whose movements are mechanically coupled among each other and which are biased into an effective position by spring force, in which position the tree trunk is immobilised. The retaining elements can jointly be taken into ineffective positions against the spring force by means of a pedal, with the pedal acting on the retaining elements in resetting direction via a coupling element. The operator depresses the pedal, and the movement thereof is transmitted to all of the retaining elements via the coupling element whereby these are returned into their ineffective positions against the resistance of their respective bias springs. While the retaining elements are in this position, the Christmas tree can be correctly installed, i.e. the bottom end of its trunk inserted into the reception, by a single person. As soon as the Christmas tree trunk has correctly assumed the vertical position, the pedal is released and the retaining elements are then brought into their effective positions by the spring force, i.e. the retaining elements now strongly press against the trunk whereby it is clamped and retained in the reception. What is disadvantageous here are the great spring forces required for securely clamping comparatively high Christmas trees with widely extending branches and possibly loaded with heavy decorations. It may consequently be very strenuous to return the retaining elements into their ineffective positions, for which purpose these great spring forces must be overcome.

In DE-PS 39 32 473, a generic Christmas tree stand is disclosed wherein a load transmission element common to all of the elements for retaining the Christmas tree trunk initially moves the retaining elements essentially free of force and independently of each other into contact with the trunk of the Christmas tree. The actual retaining force is introduced into the Christmas tree only after all of the retaining elements have been placed against its trunk. Inasmuch as the load transmission element takes effect on all of the retaining elements at the same time and with an essentially identical force, it is ensured that the preselected position of the Christmas tree trunk is not varied while increasing the retaining force due to the fact that the-effective retaining forces, irrespective of the contour of the Christmas tree trunk, cancel each other out at any point of time. The first retaining element to contact the circumferential surface of the tree trunk will not exert any force on the tree trunk until the remaining retaining elements—either concurrently or successively—also contact the circumferential surface of the tree trunk. Until the moment at which all of the retaining elements have contacted the tree trunk, practically no forces are thus applied to the tree trunk, and the preselected position thereof cannot be varied. Upon subsequent actuation of a clamping weans, the retaining forces are then introduced into the retaining elements via the load transmission element in such a manner as to cancel each other out, and a resulting force which might push the tree trunk from its position is thus not generated. In this manner it is assured that the selected position of the Christmas tree is maintained and the Christmas tree is securely held in this position by the free end of its trunk. The clamping means preferably is a kind of cable winch or ratchet, which—in the case of actuation via a pedal or manual lever—receives the load transmission element having the form of a steel cable and thus applies the great retaining forces required for secure clamping to the retaining elements.

The Christmas tree stand in accordance with DE-PS 39 32 473 has generally proven its usefulness in practical application and been widely accepted on the market. In particular Christmas trees having a crooked trunk as commonly occurring in nature may also be mounted speedily and securely in a precise vertical position by a single person. It nevertheless still has a drawback residing in the fact that the cable winch or ratchet used for actuating the clamping means gives the entire Christmas tree stand a somewhat technical/mechanical appearance which particularly in the case of Christmas tree stands will be met with rejection for esthetical reasons by some persons. Also owing to the cable winch or ratchet, which must be designed to be sturdy and reliable as it not only serves for applying the retaining forces but also for maintaining them by holding the tensile stress generated in the cable, the generic Christmas tree stand becomes heavy and expensive to produce.

In comparison, it is the object of the present invention to form a Christmas tree stand according to the preamble of claim 1 in such a manner that—while preserving the advantages provided by the generic Christmas tree stand according to DE-PS 39 32 473—the cable winch or ratchet for generating and maintaining the retaining forces described there may be disposed with such that the Christmas tree stand according to the invention can be given a more appealing appearance, be made cheaper to manufacture, and have less weight.

SUMMARY OF THE INVENTION

According to the invention, this object is attained by the characterizing features indicated in claim 1.

A Christmas tree stand according to the invention including a base, a receiving part for the Christmas tree trunk arranged at the base and having several retaining elements arranged around an axis of symmetry, each of which is movable between a retaining position and a released position such as to approach, or move away from, the axis of symmetry, and a single clamping means acting on all of the retaining elements via a load transmission element and moving the retaining elements into their respective retaining positions with an adjustable retaining force, the load transmission element being a flexible connecting part having tensile strength which initially moves all of the retaining elements essentially without force into contact with the trunk of the Christmas tree and then presses all of the retaining elements concurrently and with an essentially identical retaining force against the trunk of the Christmas tree, is correspondingly characterised in that the retaining elements essentially have the form of pins and are guided essentially horizontally and slidingly in the receiving part; that the connecting part acts on end portions of the retaining elements and under the influence of tensile load moves the retaining elements into their retaining positions; and that at least one locking mechanism is provided which prevents a return movement of the retaining elements from their retaining positions back into their released positions.

According to the invention, the retaining elements in the receiving part are correspondingly guided essentially horizontally and slidingly. A closing movement of the retaining elements in the direction of the Christmas tree trunk to be clamped is thus effected by a simple sliding movement of the retaining elements such that expensive pivot bearings or the like for the retaining elements may be dispensed with. This by itself already results in saving costs and weight. Moreover, the connecting part acts on the retaining elements at the end portions thereof and under the influence of tensile load moves them towards their retaining position. In other words, as the retaining elements are slidingly guided, the connecting part may act directly on the end portions of the retaining elements, i.e. directly in the horizontal plane of movement of the retaining elements whereby optimum introduction and transfer of force is made possible. Finally at least one locking mechanism is provided which prevents a return movement of the retaining elements from their retaining positions into their released positions. This makes it possible to do away with the central clamping means in the form of the cable winch or ratchet. When the location of the locking mechanism is suitably chosen, it may be arranged at the Christmas tree stand or the base or receiving part thereof such that it will not be visible from the outside, whereby the Christmas tree stand altogether receives an esthetically appealing appearance. Nevertheless, after relaxation of the tensile force applied on the connecting part in order to relatively shorten the latter and move the retaining elements in the direction of their retaining positions, this at least one locking mechanism prevents the retaining elements from being released from their retaining positions and ceasing to securely clamp the Christmas tree trunk.

Advantageous developments of the invention result from the subclaims.

The connecting part can act either on those portions of the retaining elements facing away from the axis of symmetry, or on those end portions of the retaining elements facing the axis of symmetry, and under the influence of tensile load move the retaining elements into their retaining positions. In either case there results a defined introduction of force with an additional advantage in the embodiment where the connecting part acts on those end portions of the retaining elements facing the axis of symmetry, in that essentially all of the connecting part extends within the receiving part and thus is not visible from the outside.

If each retaining element is associated with a locking mechanism acting in the direction of the released position, then the Christmas tree trunk is securely and fixedly clamped when the single retaining elements are in their retaining positions.

The connecting part preferably is a cable having tensile strength. Cables having tensile strength, e.g. consisting of steel wire strands or synthetic fibers, are capable of applying great forces without presenting fatigue phenomena such as elongations. Cables can moreover be guided around very small, i.e. narrow radii without great technical expense.

When the locking mechanism acts on the cable, this furnishes a central locking means equally acting on all of the retaining elements which may be centrally activated and deactivated such that speedy and secure operation of the Christmas tree stand is provided by simple and costeffective means. In addition, the locking mechanism not any more directly associated with one or several retaining elements but indirectly taking effect on them via the cable, may have a variety of designs and be adapted to the respective design of the Christmas tree stand.

The locking mechanisms associated with the retaining elements or the locking mechanism associated with the cable should preferably be releasable for the purpose of readily removing the Christmas tree trunk from its stand whenever necessary. In the case of several locking mechanisms acting on the retaining elements, they should preferably be releasable simultaneously, for example by means of a central release mechanism acting on all of the locking mechanisms at the same time when actuated.

In the case of several locking mechanisms, these are preferably arranged in the bearings or in the mounting wall for the retaining elements. Hereby it is possible to arrange the locking mechanisms such as to be invisible from the outside whereby the Christmas tree stand can be given a particularly appealing appearance.

At least one of the retaining elements is preferably biased in the direction of its released position by a spring component. When the locking mechanisms are released—either one by one or simultaneously—the at least one retaining element is moved together with the spring component in the direction of its released position such that the Christmas tree trunk is at least loosened, in the case of spring actuation of all of the retaining elements even released entirely. The spring component ist preferably a coil spring wound around the pin-shaped retaining element, which is particularly advantageous under the aspect of confined space and also for cost reasons.

The connecting component preferably is captively guided in the respective end portions of the retaining elements, for example in eyes or bores formed there, if the connecting component in accordance with the preferred embodiment is a cable having tensile strength. Hereby it is made sure that the connecting component or cable, respectively, always reliably acts on, and influences, all of the retaining elements.

Those ends of the retaining elements pointing in the direction of the retaining position are preferably provided with a point such that following contact with the surface of the Christmas tree trunk in the course of a further closing movement, they dig into the material of the Christmas tree trunk and thus render the retention thereof more reliable.

The cable may preferably be operated via a power amplification device, in particular a tackle. Hereby it is possible, even by hand, to achieve sufficiently great pull forces on the cable and thus retaining forces in the retaining elements. As soon as the required retaining forces have been applied, the cable may be released; the locking mechanisms associated with the retaining elements or the locking mechanism associated with the cable maintain the retaining forces in the cable even when the pulling force has been relaxed in the retaining elements. The tackle may subsequently be accommodated inside the base or receiving part of the Christmas tree stand such that it will not to be visible from the outside and the Christmas tree stand will acquire and optically appealing appearance.

BRIEF DESCRIPTION OF THE DRAWINGS

Further details, aspects and advantages of the present invention result from the following illustrative description by reference to the drawing, wherein.

Identical reference numerals in FIGS. 1 and 2 designate identical or analogous components.

DESCRIPTION OF THE PREFERRED EMBODIMENTS

Figure 1:
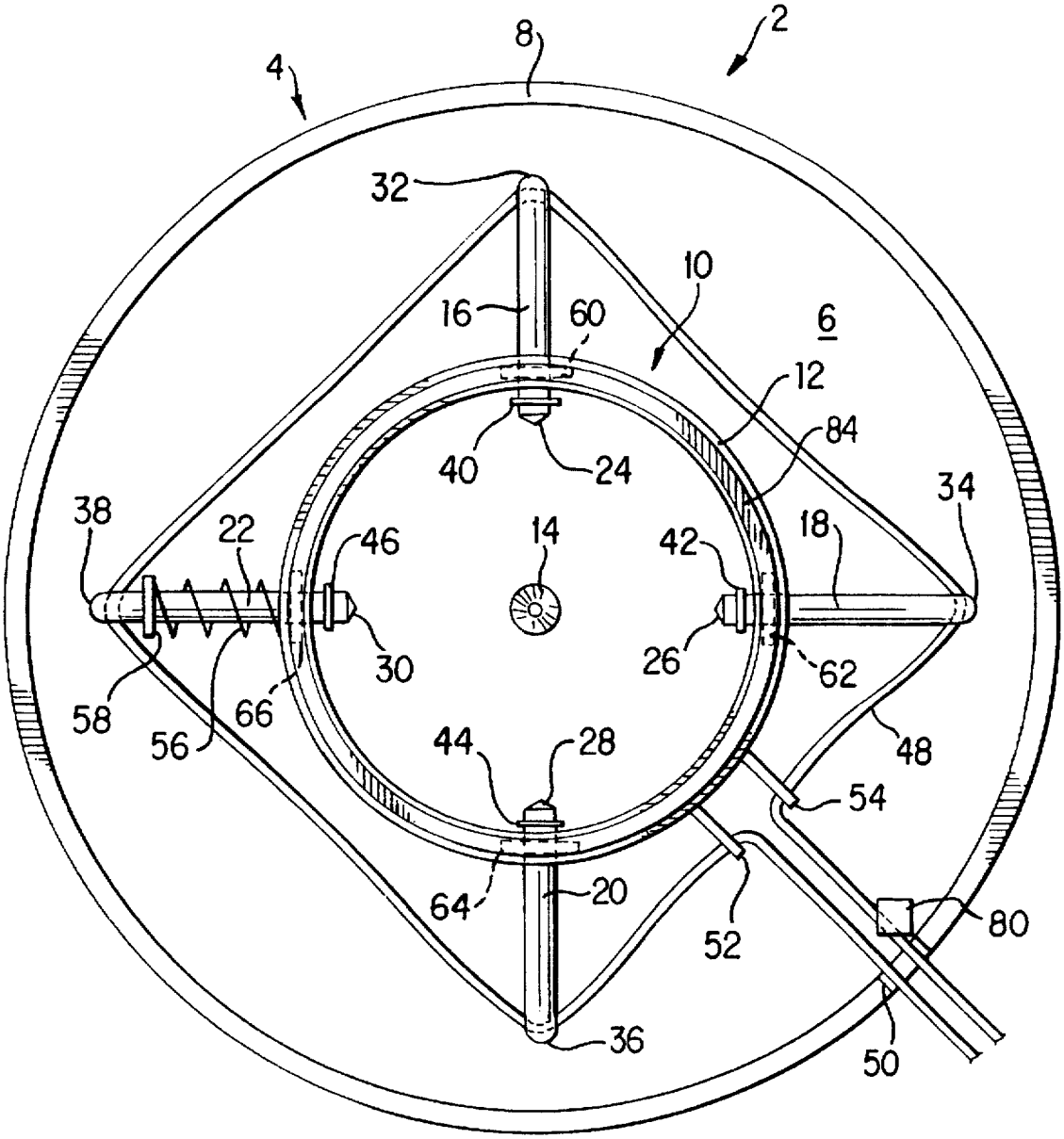
FIG. 1 in simplified schematic representation a plan view of an embodiment of a Christmas tree stand according to the invention.
Figure 2:
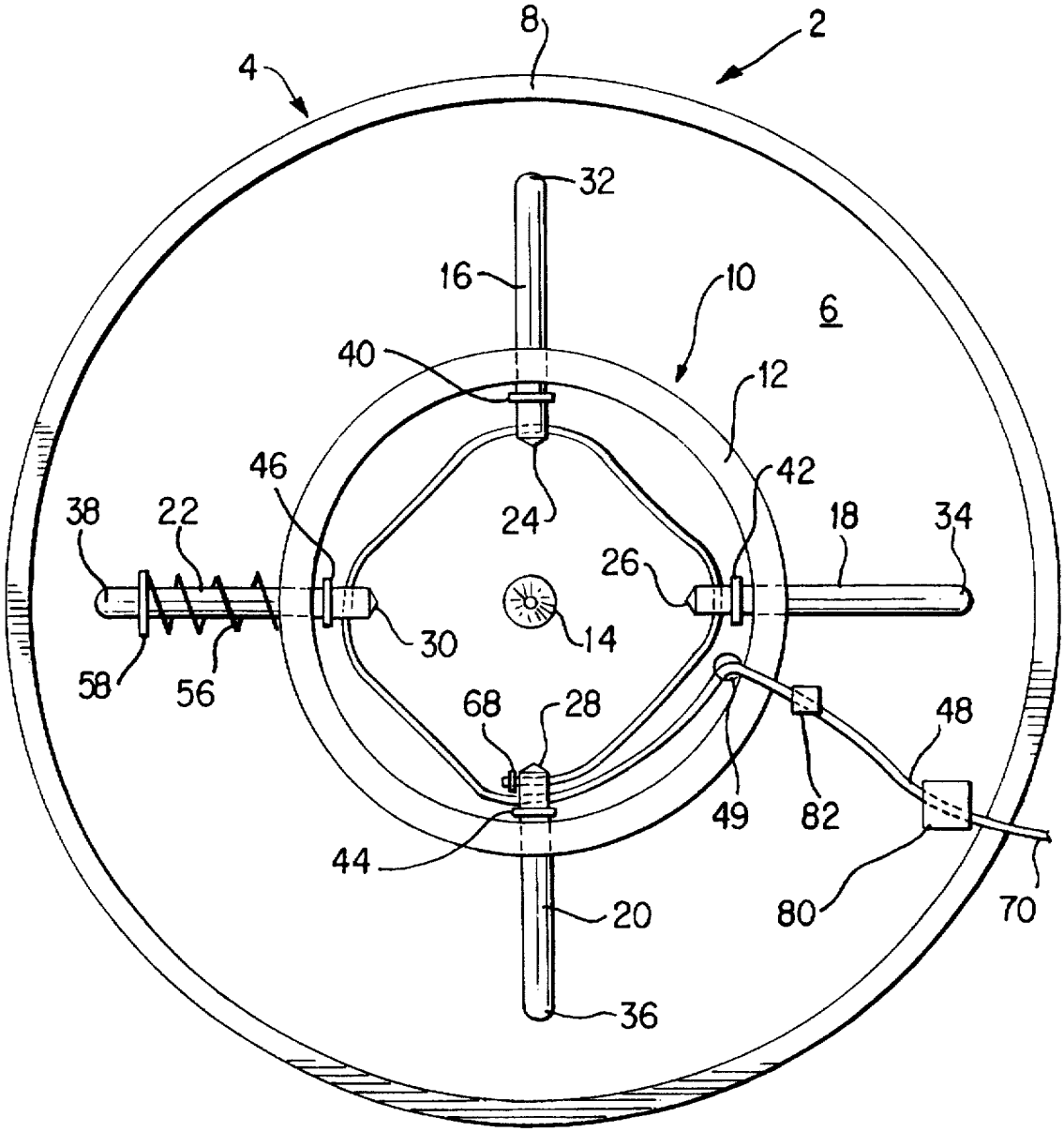
FIG. 2 shows, also in simplified schematic representation, a plan view of another embodiment of a Christmas tree stand according to the invention.

A Christmas tree stand designated throughout by 2 in FIGS. 1 and 2 essentially comprises a base 4, which in the represented embodiments consists of a base plate 6 and a peripheral wall 8 encompassing the base plate and having a certain vertical elevation in order to conceal the components located inside the Christmas tree stand 2 from view. On or in the base 4 or in the peripheral wall 8, respectively, a receiving part 10 for the trunk of a Christmas tree is arranged. In the represented embodiments, the receiving part 10 is made up of another wall 12 projecting from the base plate 6 in parallel and concentrically with the peripheral wall 8 serving as mounting wall for retaining elements, as shall be explained in the following. Concentrically with the circles defined by the walls 8 and 12, a centering spike projects 14 from the base plate 6 which pierces into the lower free end of the Christmas tree trunk.

Peripherally along the mounting wall 12, a plurality of retaining elements are arranged at equal distances. In the represented embodiments altogether four retaining elements 16, 18, 20 and 22 are provided at a respective angular distance of 90°. The retaining elements 16 to 22 are slidingly guided in the mounting wall 12 in correspondingly formed mounting openings. The movement of the retaining elements 16 to 22 thus takes place inside a plane coinciding with the plane of the drawing or extending in parallel with it.

The retaining elements 16 to 22 according to FIG. 1 and FIG. 2 are essentially pin-shaped or bolt-shaped and each comprise two end portions, namely end portions 24, 26, 28 and 30 facing an axis of symmetry which is perpendicular to the plane of the drawing and extends through the spike 14, and end portions 32, 34, 36 and 38 facing away from the axis of symmetry while pointing radially to the outside. The end portions 24 to 30 are provided with a point in the manner shown in the drawing in order to obtain better retention of a Christmas tree trunk to be clamped, as will be explained further on. Furthermore in the area of the end portions 24 to 30 on the retaining elements 16 to 22 there are stops 40, 42, 44 and 46, which prevent the retaining elements 16 to 22 from slipping from their corresponding guide means in the mounting wall 12. The stops 40 to 46 are preferably disk-shaped, thus e.g. lock washers which are held in corresponding circular grooves at the retaining elements 16 to 22.

Insofar the two embodiments of FIG. 1 and FIG. 2 are identical.

In the first embodiment according to FIG. 1, the radially external end portions 32 to 38 of the retaining elements 16 to 22 are acted upon by a load transmission element which, in the preferred embodiment, is a flexible connecting part having tensile strength, in particular a cable 48. The cable 48 is captively guided in the end portions 32 to 38 of the retaining elements 16 to 22, e.g. held in bores formed there or guided through eyes arranged at the end portions 32 to 38. The cable 48 enters—in a given case through an opening 50 in the peripheral wall 8—into the inside of the base 4, passes through a first deflecting eye 52, from there extends to the retaining element 20 or its end portion 36, respectively, and then clockwise in the drawing to the end portions 38, 32 and 34 of retaining elements 22, 16 and 18. The cable 48—as already mentiond—passes through bores or eyes in the end portions 32 to 38. Coming from the end portion 34 of the retaining element 18, the cable 48 passes through another deflecting eye 54 and then exits again from the area of the base 4—in a given case through the opening 50.

On at least one of the retaining elements, in the case of the represented embodiment on the retaining element 22, a spring element 56 is located, which in the represented embodiment is a coil spring wound around the outer circumference of the retaining element 22 and supported between the outer wall of the mounting wall 12 and a stop 58. Owing to the spring 56, the retaining element 22 is biased towards the outside, i.e. towards the left in the drawing.

In the mounting area of the retaining elements 16 to 22, i.e. in the area where the retaining elements 16 to 22 pass through the mounting wall 12, locking mechanisms 60, 62, 64 and 66 are provided. The locking mechanisms 60 to 66 are effective unilaterally, i.e. in the activated state they block a movement of the retaining elements 16 to 22 radially to the outside, whereas a movement of the retaining elements 16 to 22 radially to the inside towards the axis of symmetry or towards the spike 14 is essentially not impeded by the locking mechanisms 60 to 66. Examples for the locking mechanisms 60 to 66 shown in simplified schematic representation in the drawing are e.g. unilaterally acting positive engagement locking mechanisms comprising teeth, or friction locking mechanisms as e.g. used for so-called injection cartridges for sealants on silicon basis.

The locking mechanisms 60 to 66 associated with the retaining elements 16 to 22 can, if necessary, be released in order to allow a radial movement of the retaining elements 16 to 22 towards the outside, for example in order to release a clamped Christmas tree trunk or to prepare the receiving part 10 for receiving a Christmas tree trunk. The design of the locking mechanisms 60 to 66 may be such as to be releasable one by one, e.g. by hand, or they may simultaneously be released by means of a central release device 84, e.g. a ring coaxial with the mounting wall 12 and resting on the upper surface thereof, which upon pressure simultaneously acts downwards on the locking elements 60 to 66 and releases them.

The function of the Christmas tree stand 2 of the invention according to FIG. 1 is as follows:

FIG. 1 shows the Christmas tree stand 2 with the retaining elements 16 to 22 in their released positions projecting in an outward direction from the mounting wall 12 while the cable 48 is loosened, with the washers 40 to 46 in a given case contacting the inside of the mounting wall 12. The space inside the receiving part 10, i.e. the space confined by the mounting wall 12, is free for receiving a Christmas tree trunk to be clamped. In this position of the retaining elements 16 to 22, the Christmas tree trunk is placed into the receiving part 10, with the spike 14 digging into the bottom surface of the trunk. The two ends of cable 48 projecting from the base 4 or from the opening 50 of the peripheral wall 8, respectively, ate now grasped, with the two cable ends in a given case being provided with a grip element or a T-handle in order to better grasp the two ends of the cable 48 with one hand. While the Christmas tree is vertically aligned with one hand, a pulling force or tensile stress is applied to the cable 48 with the other hand such as to tauten and shorten it, with this shortening of the cable 48 having the effect that the retaining elements 16 to 22 are moved radially towards the inside to approach the axis of symmetry and — essentially simultaneously in the case of a perfectly round tree, one by one in the case of a tree trunk having an irregular contour—contact the trunk surface. This movement of the retaining elements 16 to 22 is not or only slightly impeded by the unilaterally acting locking mechanisms 60 to 66. If another pulling force is now applied to the cable 48, the retaining elements 16 to 22 are moved further inward in a radial direction from all sides with an identical force, with the pointed tips of end portions 24 to 30 finally digging into the material of the tree trunk and clamping the latter. While the cable 48 is tightened, a weight force is preferably furthermore applied onto the base 4 to enable application of sufficient pulling forces to the cable 48 without the Christmas tree stand being lifted. For example, a person pulling the cable 48 stands with one foot on the base plate 6.

As soon as suitable rocking motions have shown that the generated retaining forces are sufficient, the cable 48 is released and the clamped Christmas tree may also be released for it is now reliably clamped in the Christmas tree stand 2. Even though tensile stress is not present any more in the cable 48 after it was released, which is to say that forces directed towards the inside are not present any more in the single retaining elements 16 and 22, the unilaterally effective locking mechanisms 60 to 66 will block any radial return movement of elements 16 to 22 towards the outside such that the Christmas tree trunk remains clamped. The length of cable 48 projecting from the base may be inserted into the space between the walls 8 and 12 such that this length of cable is virtually invisible from the outside and the Christmas tree stand 2 has an optically appealing appearance.

As concerns the specific effective principles enabling clamping of the Christmas tree in an upright vertical position despite a crooked trunk, reference is made to DE-PS 39 32 473 by the same applicant where these effective principles are explained and described in detail. The contents disclosed there are herewith fully incorporated by way of reference.

It may turn out under practical circumstances that the forces applicable to the retaining elements 16 to 22 by means of the cable 48 are not sufficient where the cable 48 is merely tightened by hand. In order to obtain greater tensile forces in the cable 48 and thus greater retaining forces of the retaining elements 16 to 22, a power amplification device 80 may be provided, which preferably has the form of a tackle due to the fact that the connecting part is a cable 48. For this purpose, the cable 48 may be immobilised unilaterally in the area of the base 4, for example at the deflection eye 52. Starting from the eye 52, the cable 48 is again guided clockwise across the end portions 36, 38, 32 and 34, passes through the deflection eye 54, and is then guided through a tackle 80 arranged between the mounting wall 12 and the peripheral wall 8 to then exit from the area of the base 4—in a given case through the opening 50. Owing to this interposed tackle 80, the tensile forces applicable to the cable 48 may be considerably increased, such that correspondingly greater retaining forces may also be obtained. Due to its arrangement between the mounting wall 12 and the peripheral wall 8, the tackle 80 is concealed from sight such that the outer appearance of the Christmas tree stand 2 according to the invention is not impaired by the tackle.

In case the clamped Christmas tree trunk is to be released from the Christmas tree stand 2, the locking mechanisms 60 to 66—either one by one, or simultaneously by means of a central release device 84—are released, with then at least one of the retaining elements (in the represented embodiment the retaining element 22) being moved radially to the outside by the force of spring 56. If all the retaining elements 16 to 22 are provided with a spring corresponding to spring 56, all of the retaining elements 16 to 22 return to their final positions shown in the figure, wherein the Christmas tree trunk is released by the retaining elements 16 to 22 and can be taken from the Christmas tree stand 2. If, in accordance with the representation in the drawing, only one of the retaining elements is provided with the pressure spring 56 acting radially towards the outside, then only this one retaining element will return to its released position in accordance with the representation. As a general rule, however, this is enough to get the Christmas tree free from the retaining elements still applied to the trunk by repeated tilting movements in the direction of these retaining elements, to extract it from the Christmas tree stand 2.

In the second embodiment according to FIG. 2, the radially inner end portions 24 to 30 of the retaining elements 16 to 22 are acted upon by the load transmission element preferably being a cable. The cable 48 is captively guided in the end portions 24 to 30 of the retaining elements 16 to 22, for example held in bores formed there, or guided through eyes attached to the end portions 32 to 38. One of the retaining elements—in FIG. 2 the retaining element 20—includes two bores or eyes in its radially inner end portion. The cable 48 enters—in a given case also through an opening or a slot in the peripheral wall 8 and in the mounting wall 12—into the inside of the base 4, passes through an eye or a ring 49 and is from there guided to the first bore in the end portion 28 of the retaining element 20. From here it extends to the retaining element 22 or its end portion 30, respectively, and then in the drawing clockwise to the end portions 24 and 26 of the retaining elements 16 and 18. As already mentioned, the cable 48 passes through bores or eyes in the end portions 28 to 26. Coming from the end portion 26 of the retaining element 18, the cable 48 passes through another bore or eye in the end portion 28 of the retaining element 20 and is here fastened by cable sockets 68 etc.

Other than in the embodiment represented in FIG. 1, in FIG. 2 only a cable portion 70 of the cable 48 exits from the base 4.

On at least one of the retaining elements, in the represented embodiment on the retaining element 22, a spring element 56 is located, which in the represented embodiment is a coil spring wrapped around the outer circumference of the retaining element 22 and supported between the cuter wall of the mounting wall 12 and a stop 58. The spring 56 causes the retaining element 22 to be biased outwardly, i.e. towards the left side in the drawing.

The cable portion 70 of the cable 48 is acted upon by a unilaterally acting locking mechanism 82 which prevents movement of the retaining elements 16 to 22 from their retaining positions to their released positions. The locking mechanism 82 may be arranged inside or outside the peripheral wall 8 or fastened thereto. The specific design of the locking mechanism 82 lastly depends on the retaining forces to be generated and the design of the Christmas tree stand. The basic function to be fulfilled by the locking mechanism 82 is to immobilise the retaining elements in their respective retaining positions after these have been reached, i.e. to block a movement of the retaining elements 16 to 22 radially to the outside, whereas a movement of the retaining elements 16 to 22 radially towards the inside in the direction of the axis of symmetry or of the spike 14, i.e. a pulling movement at the cable portion 70 is not to be essentially impeded by the locking mechanism 82. It is to be understood that the locking mechanism 82 acting on the cable portion 70 must be releasable if necessary in order to allow a movement of the retaining elements 16 to 22 radially to the outside, for example to release a clamped Christmas tree trunk or prepare the receiving part 10 for receiving a Christmas tree trunk.

The function of the Christmas tree stand 2 according to the invention in the embodiment of FIG. 2 is as follows:

FIG. 2 shows the Christmas tree stand 2 with the retaining elements 16 to 22 in their released positions, projecting radially to the outside from the mounting wall 12 while the cable 48 is loosened, with the washers 40 to 46 in a given case contacting the mounting wall 12. The inner space of the receiving part 10, i.e. the space confined by the mounting wall 12, is free for receiving a Christmas tree trunk to be clamped. In this position of the retaining elements 16 to 22, the Christmas tree trunk is placed in the receiving part 10, with the spike 14 digging into the bottom surface of the trunk. The cable portion 70 of the cable 48 projecting from the base 4 or from an opening provided in it is grasped, with the end of the cable portion 70 in a given case being provided with a grip element or a T-handle in order to better grasp the end of the cable portion 70 with one hand. While the Christmas tree is vertically aligned with one hand, a pulling force or tensile stress is applied to the cable portion 70 with the other hand such as to tauten and shorten it, with this shortening of the cable 48 having the effect that the cable portion extending between the end portions 24 to 30 shortens whereby the retaining elements 16 to 22 are moved radially towards the inside to approach the axis of symmetry and—essentially simultaneously in the case of a perfectly round tree trunk, one by one in the case of a tree trunk having an irregular contour—contact the trunk surface. This movement of the retaining elements 16 to 22 is not or only slightly impeded by the locking mechanism 82 unilaterally acting on the cable portion 70. If another pulling force is now applied to the cable 48, the retaining elements 16 to 22 are radially moved further towards the inside from all sides with an identical force, with the pointed tips of end portions 24 to 30 finally digging into the material of the tree trunk and clamping the latter. While the cable portion 70 is tightened, preferably another weight force is applied onto the base 4 to enable application of sufficient pulling forces to the cable portion 70 without the Christmas tree stand being lifted. For example, the person pulling the cable portion 70 stands with one foot on the base plate 6.

As soon as suitable rocking motions have shown that the generated retaining forces are sufficient, the cable portion 70 is released and the clamped Christmas tree may also be released for it is now reliably clamped in the Christmas tree stand 2. Even though tensile stress is not present any more in the cable 48, which is to say that forces directed towards the inside are not present any more in the single retaining elements 16 and 22 after the cable portion 70 was released, the unilaterally acting locking mechanism 82 in the cable portion 70 will prevent a radial return movement of elements 16 to 22 towards the outside such that the Christmas tree trunk remains clamped. The length of the cable portion 70 projecting from the base may be inserted into the space between the walls 8 and 12 whereby this length of cable is virtually invisible from the outside and the Christmas tree stand 2 has an optically appealing appearance.

Concerning the specific effective principles enabling clamping of a crooked Christmas tree in an upright vertical position despite a crooked trunk, reference is again explicitly made to DE-PS 39 32 473 by the same applicant.

It may turn out under practical circumstances that the forces applicable to the retaining elements 16 to 22 by means of the cable portion 70 are not sufficient where the cable portion 70 is merely tightened by hand. In order to obtain greater pulling forces in the cable portion 70 and thus greater retaining forces of the retaining elements 16 to 22, a power amplification device 80 may also be provided in the embodiment of FIG. 2, which also preferably has the form of a tackle. Under certain circumstances, the locking mechanism 82 for the cable portion 70 may be combined with the tackle or another power amplification device 80.

In case the clamped Christmas tree trunk is to be relased from the Christmas tree stand 2, the locking mechanism 82 is released, with then at least one of the retaining elements (in the represented embodiment the retaining element 22) being moved radially to the outside under the force of spring 56. If all the retaining elements 16 to 22 are provided with a spring corresponding to spring 56, all of the retaining elements 16 to 22 return to their final positions shown in FIG. 2, wherein the Christmas tree trunk is released by the retaining elements 16 to 22 and can be taken from the Christmas tree stand 2. If, in accordance with the representation in the drawing, only one of the retaining elements is provided with the pressure spring 56 acting radially towards the outside, then only this one retaining element will return to its released position in accordance with the representation in the drawing. As a general rule, however, this is enough to get the Christmas tree free from the retaining elements still applied to the trunk by repeatedly tilting it in the direction of these retaining elements to extract it from the Christmas tree stand 2.

It should be appreciated that the above description made by reference to the drawing should be taken to be merely for illustrative purposes but not restricting. Thus e.g. the number of the retaining elements is not restricted to four; rather, three or more than four such retaining elements may be used. As mentioned above, two, three, or even all of the retaining elements may furthermore be provided with the pressure acting radially to the outside. In the place of the closed peripheral mounting wall for the retaining elements, single mounting lugs or shackles associated with the respective retaining elements may be provided which project vertically upwards from the base plate of the base and serve for slidingly guiding the retaining elements as well as for receiving or holding the locking mechanisms dienen.

In any of these cases, the result is a Christmas tree stand permitting speedy and reliable vertical positioning of a Christmas tree by a single person, with this Christmas tree stand having a simple construction and thus saving costs and weight while having an appealing optical appearance.

I claim:

1. Tree stand comprising:

a base;

a receiving part for a tree trunk arranged at said base, said receiving part having a plurality of essentially pin-shaped retaining elements arranged around an axis of symmetry, said retaining elements being guided essentially by horizontal sliding within said receiving part and having first end portions pointed toward said axis of symmetry and second end portions pointed away from said axis of symmetry, each of said retaining elements being movable between a retaining position and a released position such as to approach or move away from said axis of symmetry;

a single clamping means which acts on all of said retaining elements via a load transmission element and moves said retaining elements into their respective retaining positions with an adjustable retaining force, said load transmission element comprising a flexible, substantially inextensible connecting part having tensile strength which acts on said first or second end portions of said retaining elements and under influence of tensile load moves said retaining elements into their respective retaining positions, wherein said connecting part is adapted to initially move all of said retaining elements essentially free of a retaining force into contact with a tree trunk, and then simultaneously press all of said retaining elements with an essentially identical retaining force against the tree trunk; and at least one locking mechanism for preventing said retaining elements from moving from their respective retaining positions back into their released positions.

2. Tree stand according to claim 1, wherein said connecting part acts on said second end portions of said retaining elements.

3. Tree stand according to claim 1, wherein said connecting part acts on said first end portions of said retaining elements.

4. Tree stand according to claim 1, wherein each of said retaining elements includes one of said locking mechanism.

5. Tree stand according to claim 4, wherein said locking mechanisms are all releasable simultaneously.

6. Tree stand according to claim 1, wherein said connecting part is a cable.

7. Tree stand according to claim 6, wherein said locking mechanism acts upon said cable.

8. Tree stand according to claim 7, wherein said locking mechanism is releasable.

9. Tree stand according to claim 6, wherein said cable is operable via a power amplification device.

10. Tree stand according to claim 1, wherein said locking mechanism is releasable.

11. Tree stand according to claim 1, further comprising a mounting wall for said retaining elements, and wherein said at least one locking mechanism is arranged on said mounting wall.

12. Tree stand according to claim 1, further comprising a spring component, and wherein at least one of said retaining elements is biased by said spring component toward its released position.

13. Tree stand according to claim 12, wherein said spring component is a coil spring wrapped around said at least one retaining element.

14. Tree stand according to claim 1, wherein said connecting part is captively guided in said first or second end portions of said retaining elements.

15. Tree stand according to claim 1, wherein said first end portions of said retaining elements are provided with a point.

* * * * *